US007940158B2

(12) United States Patent
Yoneda

(10) Patent No.: US 7,940,158 B2
(45) Date of Patent: May 10, 2011

(54) CHIP RESISTOR AND ITS MANUFACTURING METHOD

(75) Inventor: Masaki Yoneda, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 502 days.

(21) Appl. No.: 12/083,448

(22) PCT Filed: Oct. 10, 2006

(86) PCT No.: PCT/JP2006/320195

§ 371 (c)(1),
(2), (4) Date: Apr. 11, 2008

(87) PCT Pub. No.: WO2007/043516

PCT Pub. Date: Apr. 19, 2007

(65) Prior Publication Data

US 2009/0040011 A1 Feb. 12, 2009

(30) Foreign Application Priority Data

Oct. 13, 2005 (JP) ..... 2005-298502
Nov. 18, 2005 (JP) ..... 2005-334140

(51) Int. Cl.
*H01C 1/012* (2006.01)

(52) U.S. Cl. ..... 338/309; 338/307; 338/308

(58) Field of Classification Search ..... 338/307–309, 338/195

See application file for complete search history.

(56) References Cited

U.S. PATENT DOCUMENTS 4,272,739 A * 6/1981 Nesses ..... 333/81 A
5,111,179 A * 5/1992 Flassayer et al. ..... 338/313
5,157,582 A * 10/1992 Sugita et al. ..... 361/321.1
5,548,269 A * 8/1996 Katsuno et al. ..... 338/325
7,667,569 B2 * 2/2010 Iseki et al. ..... 338/309
2004/0012479 A1 1/2004 Yamada et al.
2004/0239474 A1 * 12/2004 Dunn et al. ..... 338/22 R
2005/0275503 A1 12/2005 Yoneda

FOREIGN PATENT DOCUMENTS

JP 2000-216001 8/2000

(Continued)

OTHER PUBLICATIONS

International Search Report from the corresponding PCT/JP2006/320195, mailed Jan. 23, 2007.

*Primary Examiner* — Kyung Lee
(74) *Attorney, Agent, or Firm* — Hamre, Schumann, Mueller & Larson, P.C.

(57) ABSTRACT

A chip resistor (1) according to the present invention includes an insulating substrate (2) which is in the form of an elongated rectangle in plan view, a pair of upper electrodes (3, 4) in the form of a strip formed on the upper surface of the insulating substrate (2) at portions adjacent to the long side surfaces of the insulating substrate to extend along the side surfaces, a resistor film (5) formed on the upper surface of the insulating substrate (2) and electrically connected to the upper electrodes (3, 4), and a pair of terminal electrodes (6, 7) formed on the two long side surfaces of the insulating substrate and electrically connected to the upper electrodes (3, 4), respectively. One of two longitudinal ends of the resistor film (5) is connected to one of the upper electrodes (3), whereas the other one of the two longitudinal ends of the resistor film is connected to the other one of the upper electrodes (4). The connection position at which the resistor film (5) is connected to the one of the upper electrodes (3) and the connection position at which the resistor film (5) is connected to the other one of the upper electrodes (4) are spaced from each other by a predetermined distance in the longitudinal direction of the upper surface of the insulating substrate (2).

12 Claims, 7 Drawing Sheets

FOREIGN PATENT DOCUMENTS

| | | | |
|---|---|---|---|
| JP | 2001-338801 | | 12/2001 |
| JP | 2002-75704 | | 3/2002 |
| JP | 2004-218167 | * | 7/2004 |
| JP | 2005-150567 | | 6/2005 |
| JP | 2005-244059 | | 9/2005 |
| JP | 2006-19694 | | 1/2006 |

* cited by examiner

CHIP RESISTOR AND ITS MANUFACTURING METHOD

TECHNICAL FIELD

The present invention relates to a chip resistor having high surge resistance, and also to a method for manufacturing such a chip resistor.

BACKGROUND ART

Chip resistors in general include an insulating substrate and terminal electrodes for soldering, where the substrate appears to be an elongated rectangle as viewed in plan, and each of the terminal electrodes is formed on one of the two end surfaces adjacent to the shorter sides of the elongated rectangle.

FIG. 15 is a perspective view showing a typical chip resistor. The chip resistor 101 includes an insulating substrate 102 whose upper surface is formed with upper electrodes 103 and 104 disposed at the ends of the upper surface spaced from each other in the longitudinal direction of the substrate. The upper surface of the substrate 102 is also formed with a resistor film 105 extending in the longitudinal direction of the insulating substrate 102. The ends of the resistor film 105 overlap the upper electrodes 103 and 104, respectively, to be electrically connected to the electrodes 103, 104. One of the end surfaces of the insulating substrate 102 is formed with a terminal electrode 106 electrically connected to the upper electrode 103, while the other end surface of the substrate is formed with a terminal electrode 107 electrically connected to the upper electrode 104. The chip resistor 101 is mounted on e.g. a printed circuit board by soldering the terminal electrodes 106 and 107.

In the chip resistor 101, the insulating substrate 102 is prone to thermally expand or contract in its longitudinal direction by the heat generation at the resistor film 105. As noted above, the terminal electrodes 106 and 107 of the chip resistor 101 are provided on the longitudinally spaced end surfaces, and the terminal electrodes 106 and 107 are soldered to e.g. a printed circuit board. Thus, a relatively large stress due to the thermal expansion or contraction is repetitively applied to the soldered portions of the terminal electrodes 106 and 107. Further, since the area for soldering is narrow, defective soldering such as unexpected detachment of the terminals may occur.

In light of the above, a chip resistor has been proposed, in which terminal electrodes for soldering are provided on the relatively long side surfaces of an insulating substrate that appears to be an elongated rectangle as viewed in plan.

FIG. 16 is a perspective view showing a chip resistor including terminal electrodes formed on the long side surfaces. In the chip resistor 201, the upper surface of the insulating substrate 202 is formed with upper electrodes 203 and 204 along two edges spaced from each other in a direction perpendicular to the longitudinal direction. The upper surface of the insulating substrate 202 is further formed with a resistor film 205 extending in the direction perpendicular to the longitudinal direction of the substrate 202. The ends of the resistor film 205 overlap the upper electrodes 203 and 204, respectively, to be electrically connected to the electrodes 203, 204. One of the long side surfaces of the insulating substrate 202 is formed with a terminal electrode 206 electrically connected to the upper electrode 203, while the other long side surface of the insulating substrate 202 is formed with a terminal electrode 207 electrically connected to the upper electrode 204.

The chip resistor 201 is mounted on e.g. a printed circuit board by soldering the terminal electrodes 206 and 207.

In the chip resistor 201, the thermal expansion or contraction in the direction perpendicular to the longitudinal direction of the substrate 202 is smaller than the thermal expansion or contraction in the longitudinal direction. Further, with the terminal electrodes 206 and 207 provided on the long side surfaces, the soldering area of the terminal electrodes 206 and 207 is considerably increased. Thus, for the chip resistor 201, the likelihood of unexpected detachment at the soldered portions is significantly reduced.

DISCLOSURE OF THE INVENTION

In the chip resistor 201, electric current flows through the resistor film 205 in the direction perpendicular to the longitudinal direction of the substrate, which means that the current flow path is shorter than that in the resistor film 105 of the chip resistor 101. With a short current flow path, breakage or deterioration of the chip resistor is likely to occur due to the application of instantaneous high voltage or surge voltage, and in this sense the arrangement of the chip resistor 201 is unfavorable for enhancement of the surge resistance.

Another problem is as follows. The resistor film 205 may be formed with a trimming groove for resistance adjustment. A trimming groove hinders the current flow so as to provide the desired resistance. Thus, when the width of the current flow path is large, the resultant trimming groove may be a long one. In the chip resistor 201, the direction of the current flow through the resistor film 205 is perpendicular to the longitudinal direction of the substrate. Hence, the current flow path is greater in width than the current flow path in the resistor film 105 of the chip resistor 101, which necessitates a longer trimming groove. To forma longer trimming groove, however, takes a longer process time and gives rise to a cost increase.

A technical object of the present invention is to provide a chip resistor which is capable of solving the above-described problems and a method for manufacturing such a chip resistor.

According to a first aspect of the present invention, there is provided a chip resistor comprising: an insulating substrate including an elongated rectangular surface as viewed in plan; a resistor film formed on an upper surface of the insulating substrate; a pair of upper electrodes formed on the upper surface of the insulating substrate and electrically connected to the resistor film; and a pair of terminal electrodes formed on two long side surfaces of the insulating substrate, each terminal electrode being electrically connected to one of the upper electrodes. The upper electrodes includes a first upper electrode which is an elongated strip adjacent to and extending along a first long side surface of the long side surfaces of the insulating substrate, while also including a second upper electrode which is an elongated strip adjacent to and extending along a second long side surface of the long side surfaces of the insulating substrate. The resistor film includes a first longitudinal end connected to the first upper electrode, while also including a second longitudinal end connected to the second upper electrode. The chip resistor further includes a connection position at which the resistor film is connected to the first upper electrode and another connection position at which the resistor film is connected to the second upper electrode. These two connection positions are spaced from each other by a predetermined distance in the longitudinal direction of the upper surface of the insulating substrate.

Preferably, the resistor film may include: a first connection portion provided at the first longitudinal end for connection to the first upper electrode; and a second connection portion provided at the second longitudinal end for connection to the second upper electrode. The first longitudinal end of the resistor film is connected to the first upper electrode via the first connection portion, and the second longitudinal end of the resistor film is connected to the second upper electrode via the second connection portion.

Preferably, the first connection portion may be arranged adjacent to a first short end surface of the insulating substrate, and the second connection portion may be arranged adjacent to a second short end surface of the insulating substrate.

Preferably, the first connection portion and the second connection portion may be small in width.

Preferably, in the chip resistor of the first aspect, the first upper electrode may be L-shaped in plan view and include a first portion positioned adjacent to and extending along the first long side surface of the insulating substrate and a second portion positioned adjacent to and extending along the first short end surface of the insulating substrate. Likewise, the second upper electrode may be L-shaped in plan view and includes a first portion positioned adjacent to and extending along the second long side surface of the insulating substrate and a second portion positioned adjacent to and extending along the second short end surface of the insulating substrate. The first longitudinal end of the resistor film is connected to the second portion of the first upper electrodes, while the second longitudinal end of the resistor film is connected to the second portion of the second upper electrode. The paired terminal electrodes include a first terminal electrode connected to the first portion of the first upper electrode, and also a second terminal electrode connected to the first portion of the second upper electrode.

Preferably, the longitudinal ends of the resistor film may be small in width.

Preferably, each of the longitudinal ends of the resistor film may include an integral extension extending in the same direction as the second portion of a corresponding one of the upper electrodes and overlapping the second portion to be connected thereto.

Preferably, the dimension of the first portion of at least one of the paired upper electrodes along the long side surface may be smaller than a length of the long side surface. The resistor film includes a groove formed by trimming at a portion which does not face the first portion of the upper electrode.

Preferably, the resistor film may have a meandering shape between a portion connected to the first upper electrode and a portion connected to the second upper electrode.

According to a second aspect of the present invention, there is provided a method for manufacturing a chip resistor. The method comprises: a first step of forming a pair of upper electrodes on an upper surface of an insulating substrate that appears to be an elongated rectangle as viewed in plan, each of the paired upper electrodes being located adjacent to and extend along one of long side surfaces of the insulating substrate; a second step of forming a resistor film on the upper surface of the insulating substrate so that the resistor film includes longitudinal ends electrically connected to the paired upper electrodes, respectively; and a third step of forming terminal electrodes on the long side surfaces of the insulating substrate to be electrically connected to the paired upper electrodes, respectively.

Preferably, the second step may comprise: integrally forming a first connection portion for connection to one of the paired upper electrodes at one of the longitudinal ends of the resistor film while integrally forming a second connection portion for connection to the other one of the paired upper electrodes at the other one of the longitudinal ends of the resistor film so that the first and the second connection portions are electrically connected to the corresponding upper electrodes at positions spaced from each other by a predetermined distance in the longitudinal direction of the upper surface of the insulating substrate.

Preferably, the first step may comprise: forming one of the paired upper electrodes into an L-shape in plan view including a first portion positioned adjacent to and extending along one of the long side surfaces of the insulating substrate and a second portion positioned adjacent to and extending along one of two short end surfaces of the insulating substrate, and forming the other one of the upper electrodes into an L-shape in plan view including a first portion positioned adjacent to and extending along the other one of the long side surfaces of the insulating substrate and a second portion positioned adjacent to and extending along the other one of the short end surfaces of the insulating substrate. Further, the third step may comprise electrically connecting one of the terminal electrodes to the first portion of the first upper electrode and connecting the other one of the terminal electrodes to the first portion of the second upper electrode.

Preferably, in the first step, at least one of the paired upper electrodes is so formed that a dimension of the first portion thereof along the long side surface be smaller than a length of the long side surface. In addition, the method may further comprise a fourth step of forming, by trimming, a groove in the resistor film at a portion which does not face the first portion of the upper electrode, the fourth step being performed before the third step.

According to the present invention, defective soldering due to the thermal expansion or contraction of the insulating substrate is reduced, and the current flow path can be long and narrow, to provide enhanced surge resistance. Further, the time required for forming a groove by trimming is reduced, which contributes to reduction in manufacturing cost.

BEST MODE FOR CARRYING OUT THE INVENTION

Preferred embodiments of the present invention will be described below with reference to the accompanying drawings.

Figure 1:
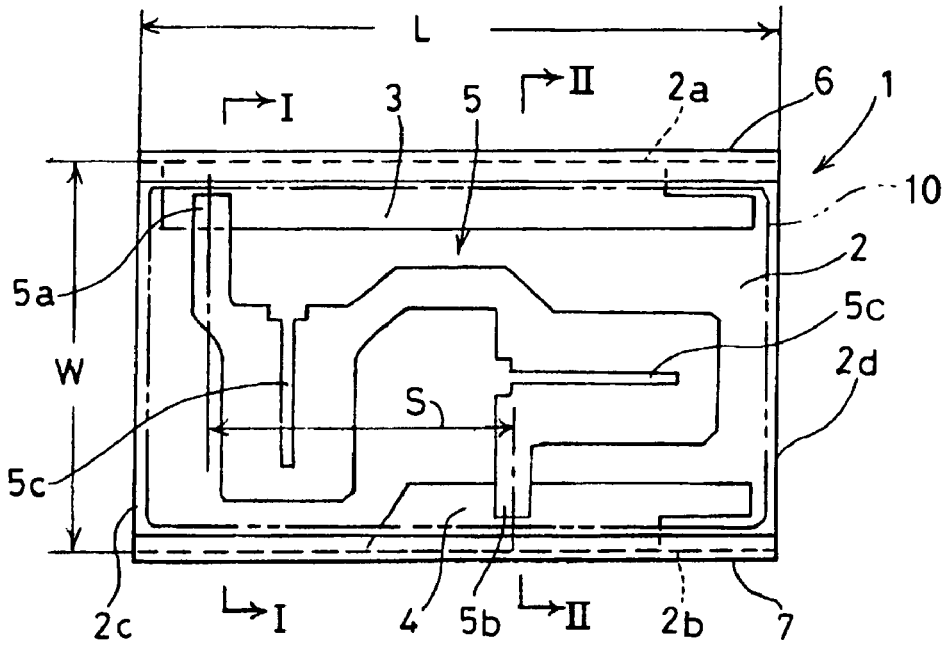
FIG. 1 is a plan view showing a chip resistor according to a first embodiment of the present invention.
Figure 2:
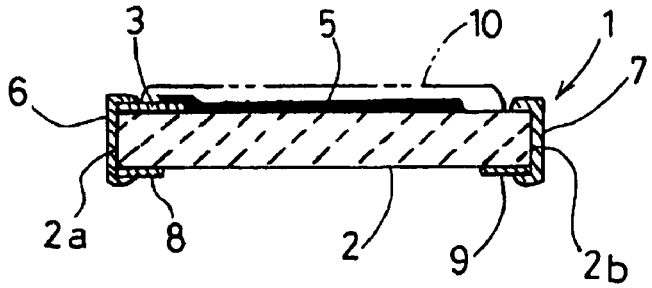
FIG. 2 is a sectional view taken along lines I-I in FIG. 1.
Figure 3:
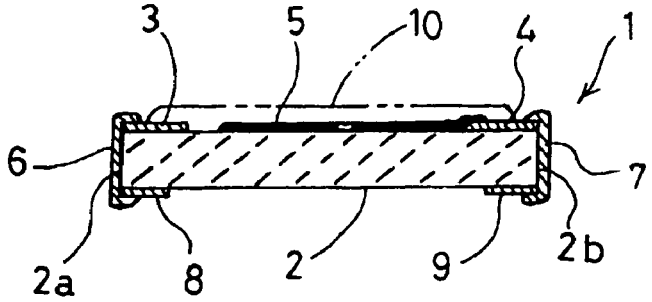
FIG. 3 is a sectional view taken along lines II-II in FIG. 1.

FIGS. 1-3 show a chip resistor according to a first embodiment of the present invention.

The chip resistor 1 according to the first embodiment at least includes an insulating substrate 2, a pair of upper electrodes 3 and 4, a resistor film 5, a pair of terminal electrodes 6 and 7, a pair of lower electrodes 8 and 9 and a cover coat 10.

The insulating substrate 2 is made of a heat-resistant insulating material such as a ceramic material and in the form of a chip having an elongated rectangular shape with a longer side L and a shorter side W. The upper electrode 3 is in the form of a strip formed on the upper surface of the insulating substrate 2 at a portion adjacent to a longer side surface 2*a* to extend along the longer side surface 2*a*. The upper electrode 4 is in the form of a strip formed on the upper surface of the insulating substrate 2 at a portion adjacent to a longer side surface 2*b* to extend along the longer side surface 2*b*. The resistor film 5 is formed between the upper electrodes 3 and 4 on the upper surface of the insulating substrate 2 to extend in the longitudinal direction of the insulating substrate 2.

The terminal electrode 6 is formed on the longer side surface 2*a* of the insulating substrate 2 to extend along the entire length of the surface 2*a*. The terminal electrode 7 is formed on the longer side surface 2*b* of the insulating substrate 2 to extend along the entire length of the surface 2*b*. In mounting the chip resistor 1 on e.g. a printed circuit board, the terminal electrodes 6 and 7 are used as the solder terminals. The lower electrode 8 is formed on the lower surface of the insulating substrate 2 at a portion adjacent to the longer side surface 2*a* to extend along the longer side surface 2*a*. The lower electrode 9 is formed on the lower surface of the insulating substrate 2 at a portion adjacent to the longer side surface 2*b* to extend along the longer side surface 2*b*. The cover coat 10 is made of glass or synthetic resin and formed on the upper surface of the insulating substrate 2 to cover the entirety of the resistor film 5.

The upper electrodes 3 and 4, the resistor film 5 and the lower electrodes 8 and 9 are made by the screen-printing of a material paste and the subsequent baking. The terminal electrodes 6 and 7 are made by the application of a material paste and the subsequent baking. The cover coat 10 is made by the screen-printing of a material paste and the subsequent drying or baking.

The terminal electrode 6 overlaps and is electrically connected to the upper electrode 3 and the lower electrode 8. The terminal electrode 7 overlaps and is electrically connected to the upper electrode 4 and the lower electrode 9.

The resistor film 5 includes a narrow connection portion 5*a* integrally formed at an end of the film to overlap and be electrically connected to the upper electrode 3. The resistor film 5 further includes a narrow connection portion 5*b* integrally formed at another end to overlap and be electrically connected to the upper electrode 4. The connection portions 5*a* and 5*b* are connected to the upper electrodes 3 and 4, respectively, while being spaced from each other by a distance S in the longitudinal direction of the insulating substrate 2.

In this embodiment, the resistor film 5 has a section sandwiched between the two connection portions 5*a*, 5*b* (called "resistive section" below) and provided with a plurality of bends (thereby forming a meandering path). Specifically, the resistive section includes a first U-shaped resistor portion extending from the connection portion 5*a* and oriented perpendicularly to the longitudinal direction of the substrate 2, and a second U-shaped resistor portion extending from the connection portion 5*b* and oriented longitudinally of the substrate 2. The two U-shaped resistor portions are connected to each other at a central region of the insulating substrate 2. The resistor film 5, including the resistive section, is formed in the following way. First, a resistor film is formed on the upper surface of the substrate 2 by the screen-printing and subsequent baking of an appropriate material, where the resistor film has a pattern corresponding to the connection portions 5*a*, 5*b* and the resistive section (with no groves 5*c*). Then, two grooves 5*c* for resistance adjustment are formed in the resistive section of the resistor film 5 by a laser trimming method, for example.

In the trimming process, the resistance can be adjusted by one or both of the two grooves 5*c*. In the case where the resistance is adjusted by a single groove, a first groove 5*c* is formed to a certain length, and then a second groove 5*c* is formed to have such a length that makes the resistance of the resistor film 5 fall in a predetermined allowable range. In the case where the resistance is adjusted by both the grooves, a first groove 5*c* is formed to such a length that makes the resistance of the resistor film 5 fall in a predetermined allowable range for rough adjustment, and then a second groove 5*c* is formed have such a length that makes the resistance of the resistor film 5 fall in a predetermined allowable range for fine adjustment.

The meandering shape of the resistive section of the resistor film 5 may be afforded other than by laser-trimming. For instance, the meandering resistive section may be provided by screen-printing with the use of a print pattern whose configuration corresponds exactly to the desired meandering shape. Alternatively, in forming the resistor film 5 by screen-printing and the subsequent baking, the resistive section may be formed as to include only a limited number of bends of the desired meandering shape. Then, the complete meandering shape may be provided by the subsequent forming of the remaining bend(s) by making grooves 5*c* by laser-trimming. In the latter case, the resistance adjustment and the completion of the meandering shape of the resistive section are performed simultaneously in forming the grooves 5*c*.

Though not illustrated, a metal plating layer, such as a solder layer suitable for attaining proper soldering, is formed on the exposed surfaces of the upper electrodes 3, 4 not covered by the cover coat 10, on the surfaces of the terminal electrodes 6, 7 and on the surfaces of the lower electrodes 8, 9.

With the chip resistor 1 described above, the soldering to a printed circuit board is performed through the terminal electrodes 6 and 7, which are formed on the longer side surfaces 2*a* and 2*b* of the substrate 2. Thus, as compared with the chip resistor 201 shown in FIG. 16, the likelihood of incurring defective soldering such as unexpected terminal detachment is considerably reduced.

As noted above, the resistor film 5 is connected to the upper electrodes 3 and 4 in the following manner. The resistor film 5 is provided with the connection portions 5*a* and 5*b*, which are spaced from each other by an appropriate distance S as measured in the longitudinal direction of the insulating substrate 2, and these connection portions 5*a* and 5*b* are connected to the upper electrodes 3 and 4, respectively. Accordingly, the length of the current flow path in the resistor film 5 is longer than that in the chip resistor 201 shown in FIG. 16.

Figure 16:
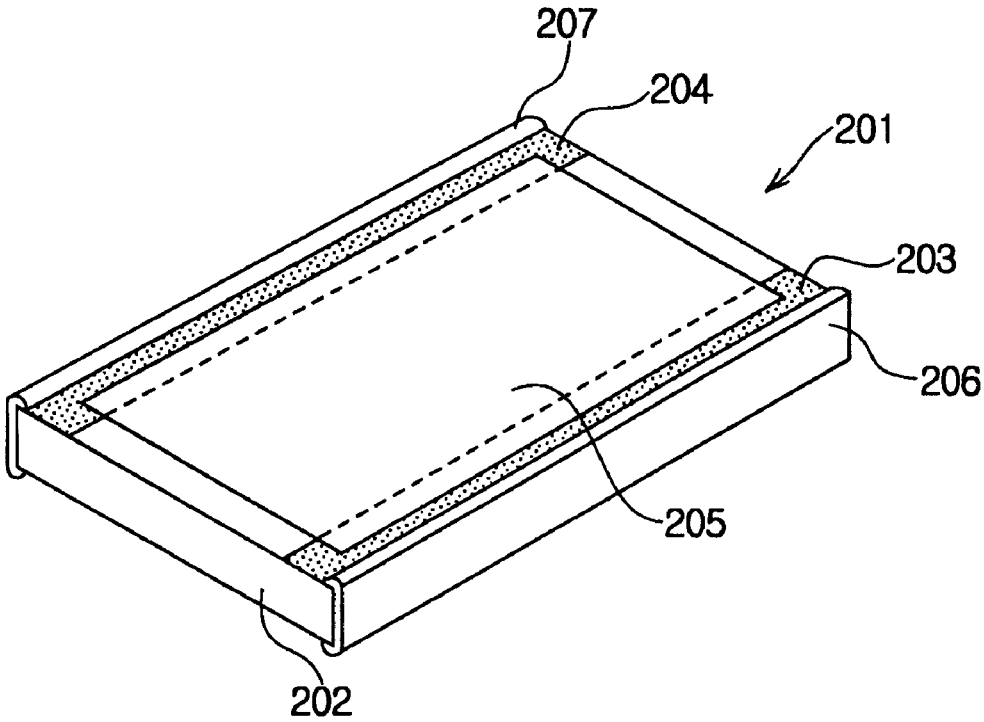
FIG. 16 is a perspective view showing a conventional chip resistor including terminal electrodes formed on longer side surfaces.

In the chip resistor 201, the current flow path in the resistor film 205 extends generally in parallel with the end surfaces of the insulating substrate 202. On the other hand, the above arrangement whereby the connection portions 5*a*, 5*b* are connected to the upper electrodes 3, 4 may compare with an arrangement whereby the rectangular resistor film 205 shown in FIG. 16 is connected to the upper electrodes 206, 207 only through locally limited portions disposed diagonally of the resistor film 205. In this arrangement, the current flow path in the resistor film 205 extends along the diagonal of the rectangular resistor film 205. Thus, by connecting the connection portions 5*a* and 5*b* to the upper electrodes 3 and 4, the current flow path in the resistor film 5 becomes longer than that in the chip resistor 201 shown in FIG. 16.

Further, the resistive section of the resistor film 5 has a meandering shape as noted above, which considerably increases the current flow path in the resistor film 5. Hence, the surge resistance of the chip resistor 1 is considerably higher than that of the chip resistor 201 shown in FIG. 16.

Further, since the resistive section of the resistor film 5 has a smaller width than the chip resistor 201 shown in FIG. 16, the length of the grooves 5*c* for adjusting the resistance of the resistor film 5 can be shorter than that in the chip resistor 201. Accordingly, the time required for forming the grooves 5*c* by laser-trimming is reduced, which contributes to a reduction in the manufacturing cost.

Figure 4:
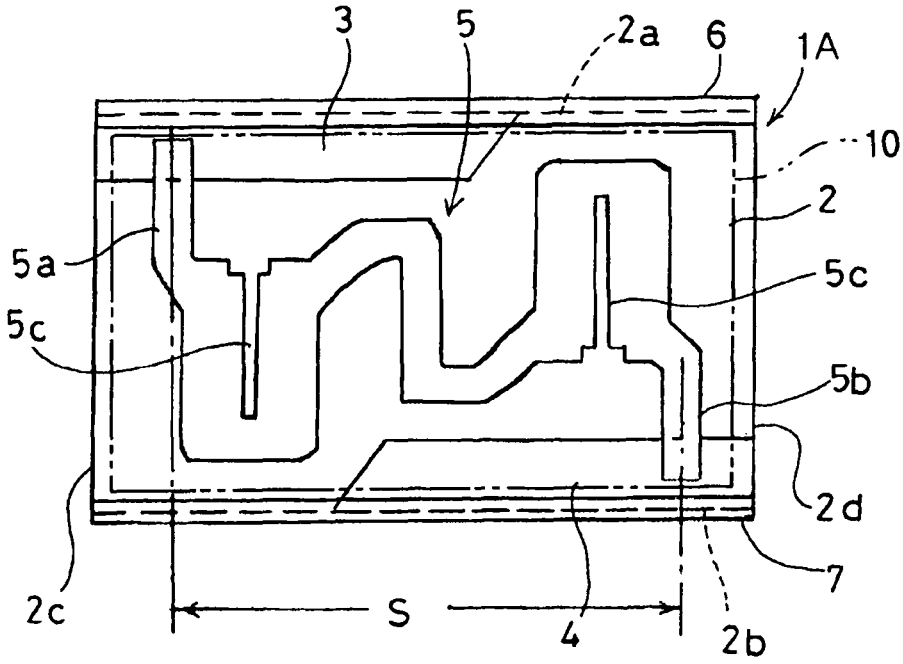
FIG. 4 is a plan view showing a chip resistor according to a second embodiment of the present invention.

Referring to FIG. 4, a chip resistor 1A according to a second embodiment of the present invention will be described.

The chip resistor 1A shown in FIG. 4 has a configuration different from that of FIG. 1 in that the second U-shaped resistor portion connected to the connection portion 5*b* is oriented in the direction perpendicular to the longitudinal direction of the insulating substrate 2, and in that the two U-shaped resistor portions are connected to each other via an S-shaped resistor portion. This structure may compare with a structure obtained by turning the U-shaped resistor portion connected to the connection portion 5*b* of FIG. 1 counterclockwise by 90 degrees.

In the chip resistor 1A of the second embodiment, the position at which the connection portion 5*b* is connected to the upper electrode 4 is closer to the end surface 2*d* than in the chip resistor 1 of the first embodiment. Thus, the distance S between the two connection portions 5*a* and 5*b*, and hence the length of the resistive section of the resistor film 5 are longer than those of the chip resistor 1. As a result, the surge resistance of the chip resistor 1A according to the second embodiment is higher than that of the chip resistor 1 according to the first embodiment. Further, by narrowing down the connection portions 5*a* and 5*b* of the resistor film 5, the length of the current flow path can be made greater, and the surge resistance can be enhanced.

Figure 5:
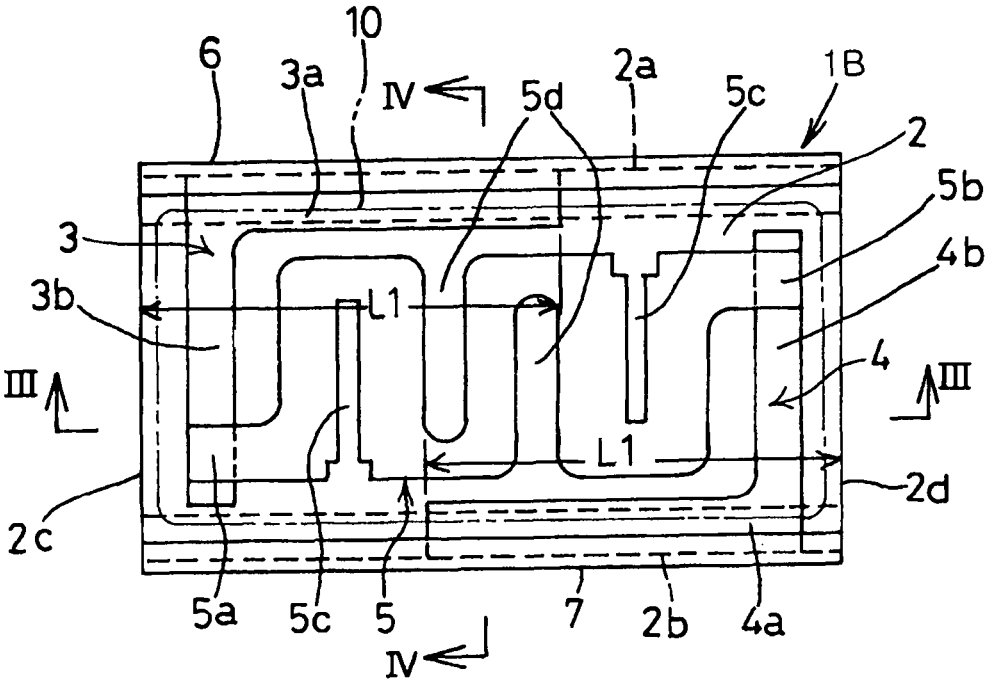
FIG. 5 is a plan view showing a chip resistor according to a third embodiment of the present invention.
Figure 6:
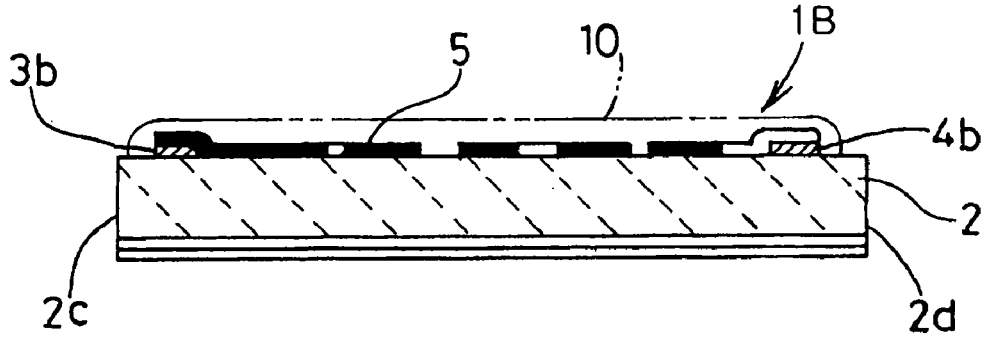
FIG. 6 is a sectional view taken along lines III-III in FIG. 5.
Figure 7:
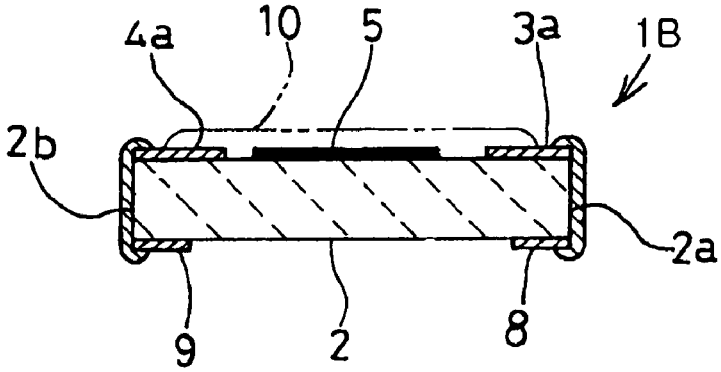
FIG. 7 is a sectional view taken along lines IV-IV in FIG. 5.

FIGS. 5-7 show a chip resistor 1B according to a third embodiment of the present invention.

The chip resistor 1B differs from the chip resistor 1 of the first embodiment in shape of the upper electrodes 3, 4 and resistor film 5 and the connection between the upper electrodes 3, 4 and the resistor film 5.

The upper electrodes 3 and 4 are L-shaped as viewed in plan. The upper electrode 3 includes a first portion 3*a* which is in the form of a strip formed on the upper surface of the insulating substrate 2 at a portion adjacent to the longer side surface 2*a* to extend along the longer side surface 2*a*. The upper electrode 3 further includes a second portion 3*b* which is in the form of a strip formed on the upper surface of the insulating substrate 2 at a portion adjacent to the short end surface 2*c* to extend along the short end surface 2*c*. The upper electrode 4 includes a first portion 4*a* which is in the form of a strip formed on the upper surface of the insulating substrate 2 at a portion adjacent to the longer side surface 2*b* to extend along the longer side surface 2*b*. The upper electrode 4 further includes a second portion 4*b* which is in the form of a strip formed on the upper surface of the insulating substrate 2 at a portion adjacent to the short end surface 2*d* to extend along the short end surface 2*d*. The dimension of the first portion 3*a*, 4*a* of each upper electrode in the direction along the longer sides is shorter than the longer side surfaces of the insulating substrate 2, so that the first portions do not hinder formation of the grooves 5*c* in the resistor film 5 by laser-trimming.

The resistor film 5 is formed between the second portions 3*b* and 4*b* of the upper electrodes 3 and 4 on the upper surface of the insulating substrate 2 to extend in the longitudinal direction of the insulating substrate 2. The connection portion 5*a* of the resistor film 5 overlaps and is electrically connected to the second portion 3*b* of the upper electrode 3. The connection portion 5*b* of the resistor film 5 overlaps and is electrically connected to the second portion 4*b* of the upper electrode 4.

The resistive section of the resistor film 5 has a meandering shape. The resistive section having the meandering shape is formed by forming the resistor film 5 shown in FIG. 5 in the state free from grooves 5*c* on the upper surface of the insulating substrate 2 by screen-printing and the subsequent baking and then forming two grooves 5*c* by laser-trimming. That is, the bend at the center of the resistive section of the resistor film 5 is made by screen-printing using a resistor pattern including the bend formed by two grooves 5*d*, whereas the bends on the opposite sides in the resistive section are made by forming two grooves 5*c* by laser-trimming. The structure of other portions is the same as that of the first embodiment (see FIGS. 1-3).

With this arrangement, the connection portion 5*a* of the resistor film 5 is positioned adjacent to the short end surface 2*c* of the insulating substrate 5, whereas the connection portion 5*b* is positioned adjacent to the short end surface 2*d*. Thus, as compared with the chip resistor 201 shown in FIG. 16, the length of the current flow path in the resistor film 5 is longer, so that the surge resistance is higher. Further, since the grooves 5*c* of the resistor film 5 are relatively short, the time required for forming the grooves 5*c* is relatively short, which leads to a reduction in the manufacturing cost.

With the meandering shape of the resistive section of the resistor film 5, the length of the current flow path is considerably increased, whereby the surge resistance is considerably enhanced. Further, by making the connection portions 5*a* and 5*b* of the resistor film 5 narrow, the length of the current flow path is increased so that the surge resistance is further enhanced.

Further, the dimension of the first portion 3*a*, 4*a* of each upper electrode in the direction along the longer sides is shorter than the longer side surfaces of the insulating substrate 2, and the groove 5*c* is formed, by laser-trimming, in the resistor film 5 at a portion on the outer side of which the first portion 3*a*, 4*a* of the upper electrode does not exist. Thus, in forming the grooves 5*c* by subjecting the resistor film 5 to laser-trimming, the first portions 3*a*, 4*a* of the upper electrodes are not damaged. Thus, in the trimming process, it is not necessary to take care not to damage the upper electrodes, so that the time required for the trimming for forming the grooves 5*c* is shortened.

Figure 8:
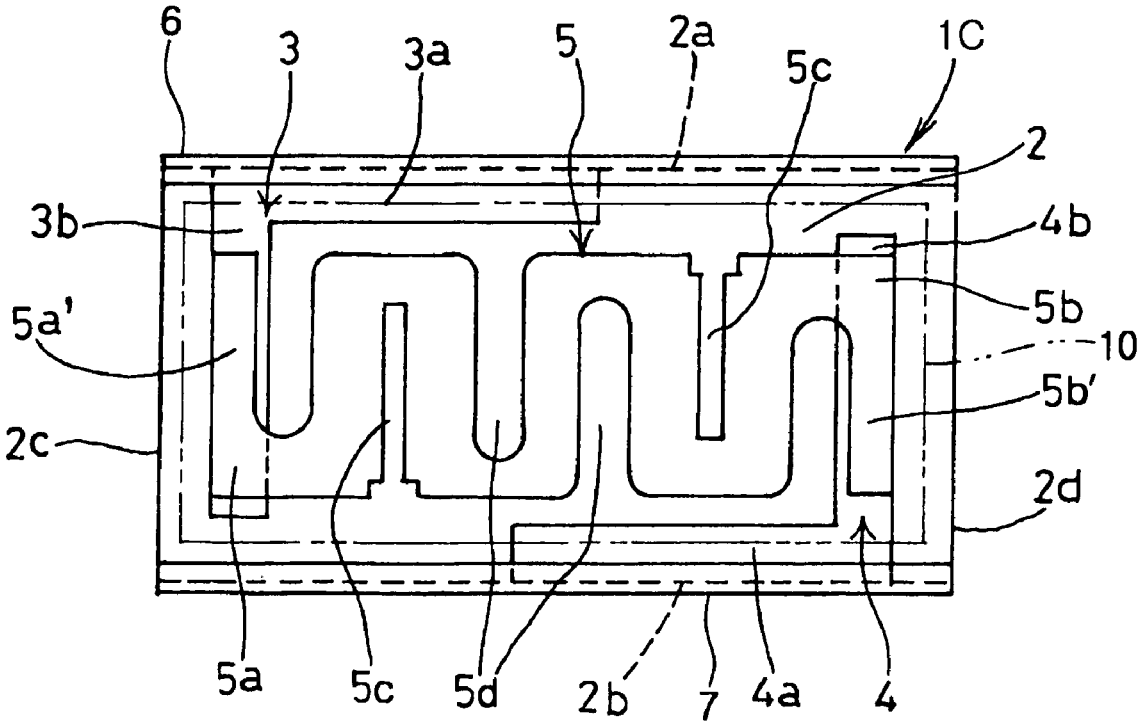
FIG. 8 is a plan view showing a chip resistor according to a fourth embodiment of the present invention.

FIG. 8 shows a chip resistor 1C according to a fourth embodiment of the present invention.

In the chip resistor 1C, the connection portions 5*a* and 5*b* at the two ends of the resistor film 5 are integrally formed with extensions 5*a*' and 5*b*' extending in the same direction as the second portions 3*b* and 4*b* of the upper electrodes and overlapping the second portions 3*b* and 4*b* to be connected to these portions, respectively. The structure of other portions is the same as that of the third embodiment (see FIGS. 5-7).

In forming the upper electrodes 3, 4 and the resistor film 5 separately by screen-printing, positional deviation may occur between the upper electrodes 3, 4 and the resistor film 5. In the third embodiment shown in FIG. 5, the connection portion 5*a*, 5*b* of the resistor film 5 and the second portion 3*b*, 4*b* of the upper electrode 3, 4, which are generally equal in width, extend perpendicularly to each other and connected to each other at the overlapping portions. With this arrangement, when the resistor film 5 deviates in the longitudinal direction of the insulating substrate 2 in the printing process, the overlapping area of the connection portion 5*a*, 5*b* of the resistor film 5 and the second portion 3*b*, 4*b* of the upper electrode 3, 4 reduces.

In this case, in the third embodiment, heat is not effectively dissipated from the resistor film 5 through the upper electrodes 3, 4, so that the resistor film 5 retains heat. Thus, the chip resistor may not be satisfactory in terms of the overload characteristics (STOL: Short Term Over Load). In the forth embodiment, however, the connection portions 5*a* and 5*b* of the resistor film 5 are integrally formed with extensions 5*a*' and 5*b*' extending in the same direction as the second portions 3*b* and 4*b* of the upper electrodes 3 and 4 and overlapping the second portions 3*b* and 4*b* to be connected to these portions, respectively. With this arrangement, the connection area between the connection portions 5*a* and 5*b* of the resistor film 5 and the second portions 3*b* and 4*b* of the upper electrodes 3 and 4 is relatively large. Thus, even when the resistor film 5 deviates in the longitudinal direction of the insulating substrate 2 in the printing process, a relatively large connection area is secured. Thus, the overload characteristics of the chip resistor are higher than that of the third embodiment.

Preferably, the chip resistors 1, 1A, 1B, 1C according to the first through the fourth embodiments may be manufactured by the method described below. It is to be noted that the method for manufacturing the chip resistor 1 according to the first embodiment will be described below as an example.

Figure 9:
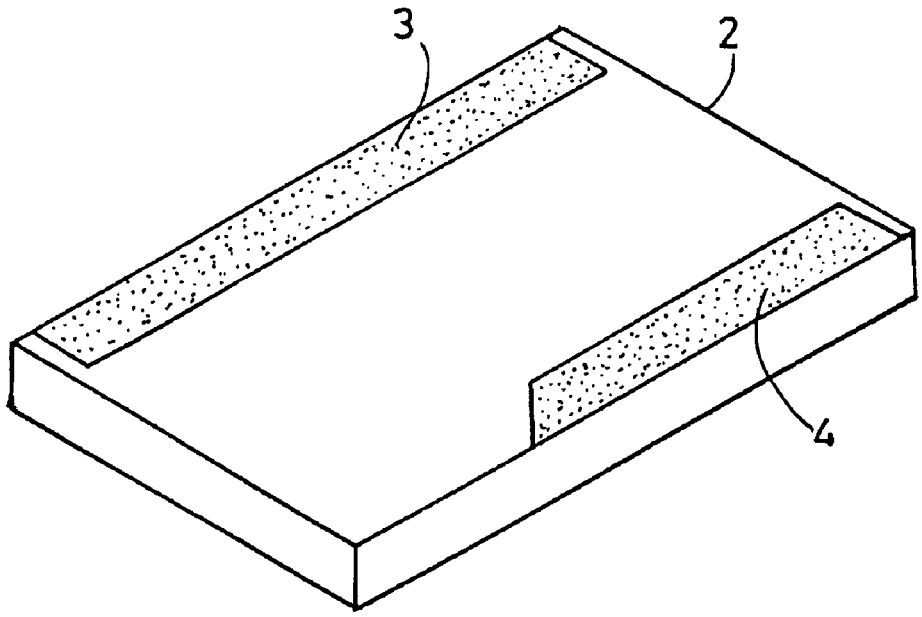
FIG. 9 is a perspective view showing a first step of a method for manufacturing a chip resistor according to the first embodiment.
Figure 10:
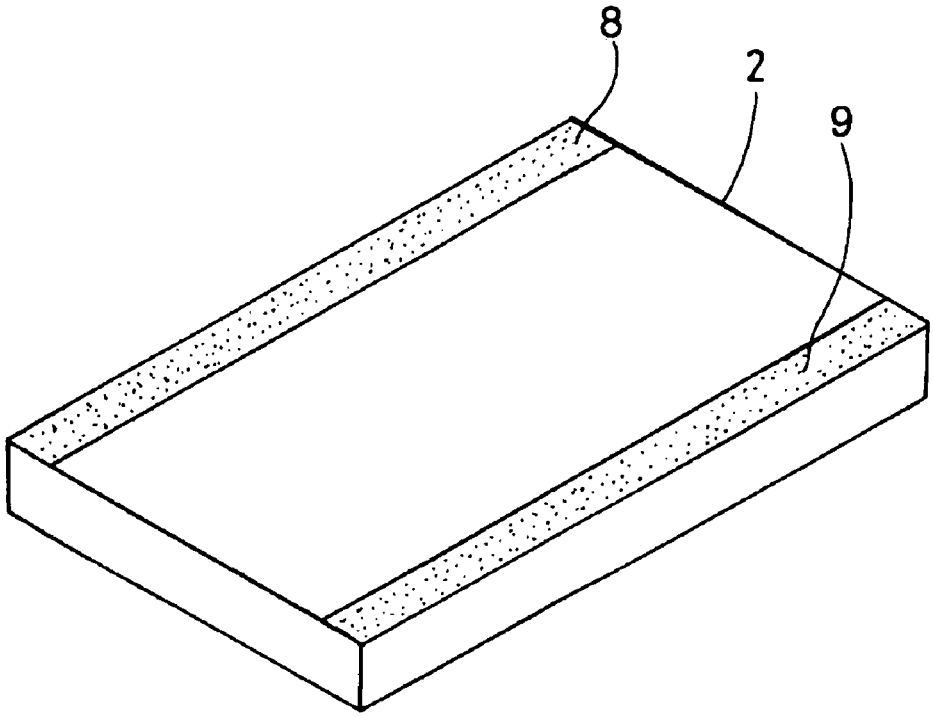
FIG. 10 is a perspective view showing a second step of the method for manufacturing a chip resistor according to the first embodiment.
Figure 11:
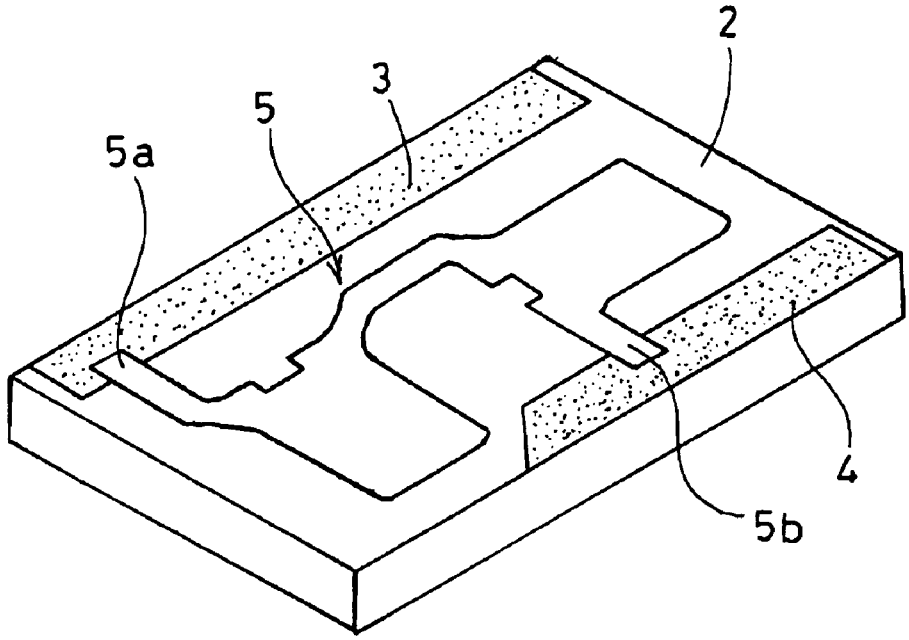
FIG. 11 is a perspective view showing a third step of the method for manufacturing a chip resistor according to the first embodiment.

First, in the method for manufacturing the chip resistor 1, a pair of upper electrodes 3 and 4 each in the form of a strip are formed on the upper surface of an insulating substrate 2 which in the form of a chip having an elongated rectangular shape, as shown in FIG. 9. Then, as shown in FIG. 10, a pair of lower electrodes 8 and 9 are formed on the lower surface of the insulating substrate 2 along the two longer side surfaces 2*a* and 2*b* of the insulating substrate. Further, as shown in FIG. 11, a resistor film 5 is formed between the two upper electrodes 3 and 4 on the upper surface of the insulating substrate 2 so that the connection portions 5*a* and 5*b* overlap and are connected to the upper electrodes 3 and 4, respectively. These three steps are performed by the screen-printing of a material paste and the subsequent baking.

The above-described three steps may be performed in an order different from the above. For instance, the upper electrodes 3, 4 may be formed after the lower electrodes 8, 9 are formed, and then the resistor film 5 may be formed. Alternatively, the resistor film 5 may be formed after the lower electrodes 8, 9 are formed, and then the upper electrodes 3, 4 may be formed.

Figure 12:
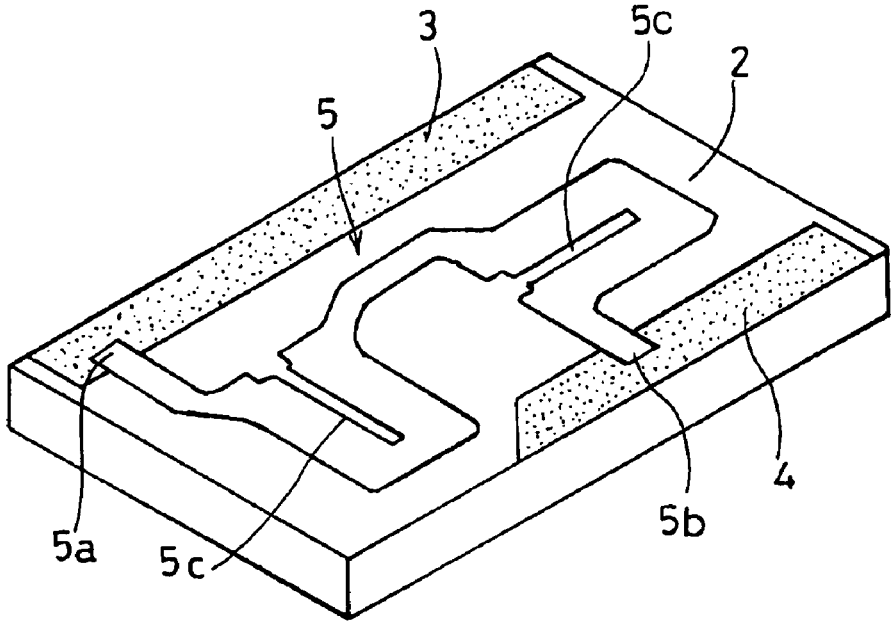
FIG. 12 is a perspective view showing a fourth step of the method for manufacturing a chip resistor according to the first embodiment.

Then, in the method for manufacturing the chip resistor 1, grooves 5*c* are formed in the resistor film 5, as shown in FIG. 12. In forming the grooves 5*c*, probes are brought into contact with the upper electrodes 3 and 4 to measure the resistance of the resistor film 5, and the length of each groove 5*c* is adjusted so that the resistor film has a predetermined resistance.

Figure 13:
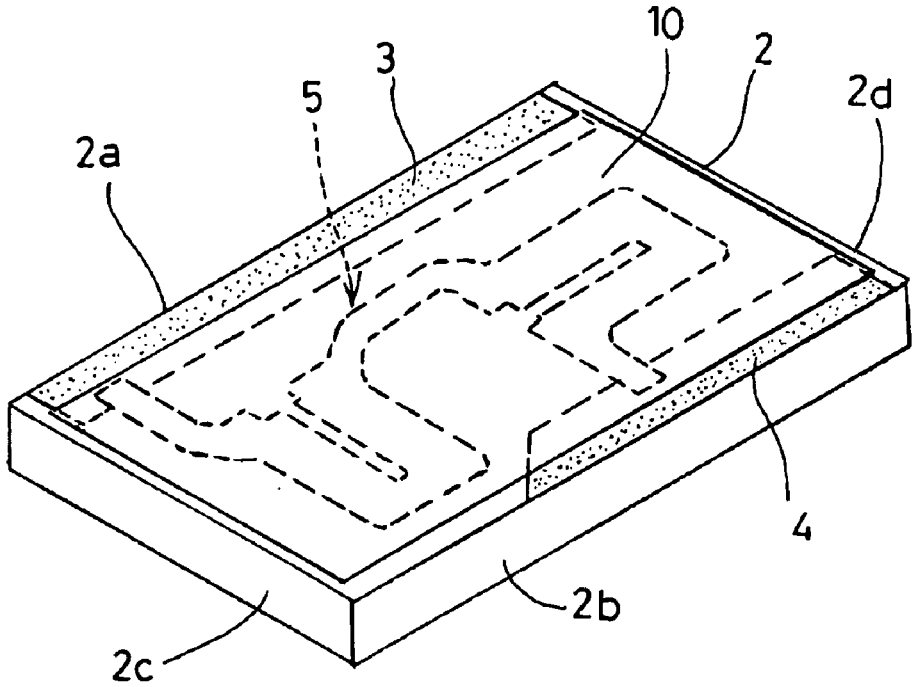
FIG. 13 is a perspective view showing a fifth step of the method for manufacturing a chip resistor according to the first embodiment.
Figure 14:
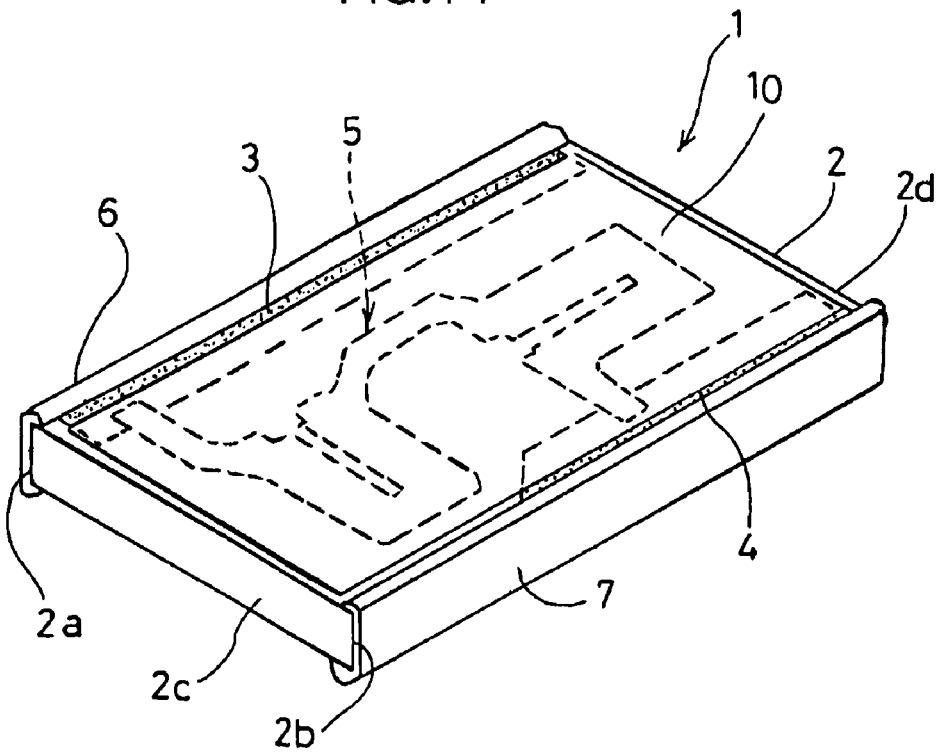
FIG. 14 is a perspective view showing a sixth step of the method for manufacturing a chip resistor according to the first embodiment.
Figure 15:
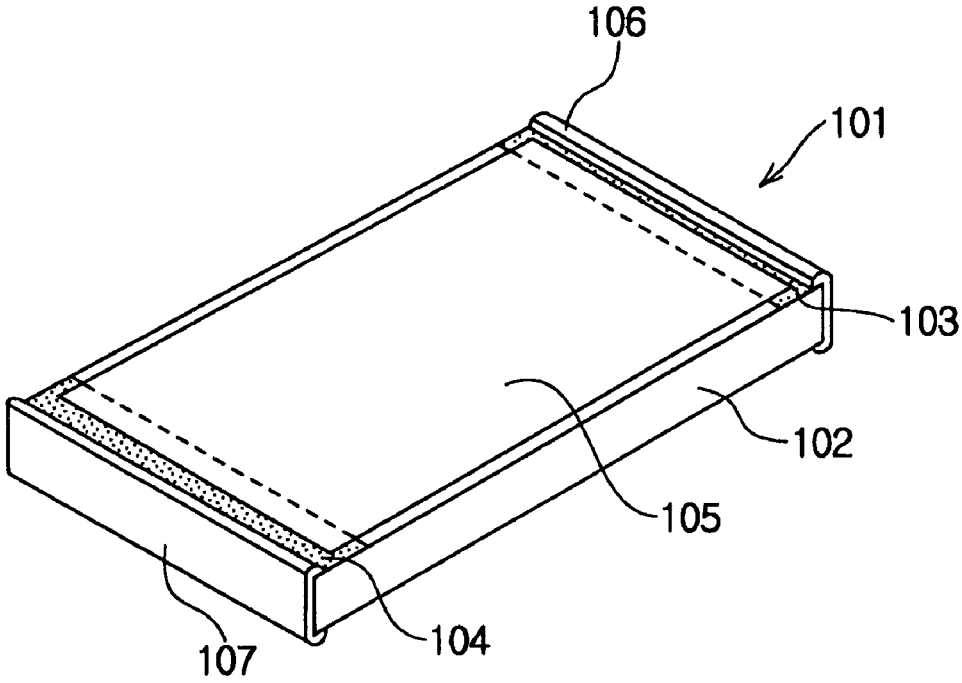
FIG. 15 is a perspective view showing a conventional typical chip resistor.

Then, in the method for manufacturing the chip resistor 1, a cover coat 10 is formed on the upper surface of the insulating substrate 2 to cover the resistor film 5, as shown in FIG. 13. This step is performed by the screen-printing of a material paste and the subsequent drying or baking. Then, as shown in FIG. 14, terminal electrodes 6, 7 are formed on the two longer side surfaces 2*a*, 2*b* of the insulating substrate 2 to partially overlap the upper electrodes 3, 4 and the lower electrodes 8, 9. This step is performed by the application of a material paste and the subsequent baking. Then, though not illustrated, a metal plating layer is formed on the upper electrodes 3 and 4, the terminal electrodes 6 and 7 and the lower electrodes 8 and 9 by e.g. barrel plating.

With the above-described method, the chip resistors 1, 1A, 1B and 1C having the above-described structure is manufactured at a relatively low cost.

The invention claimed is:

1. A chip resistor comprising:

an insulating substrate including an elongated rectangular surface as viewed in plan, the insulating substrate including a first long side surface, a second long side surface opposite to the first long side surface, a first short side surface, and a second short side surface opposite to the first short side surface;

a resistor film formed on an upper surface of the insulating substrate;

a pair of upper electrodes formed on the upper surface of the insulating substrate and electrically connected to the resistor film; and a pair of terminal electrodes formed on two long side surfaces of the insulating substrate, each terminal electrode being electrically connected to one of the upper electrodes; wherein:

the upper electrodes include a first upper electrode which is an elongated strip adjacent to and extending along the first long side surface of the insulating substrate;

the upper electrodes include a second upper electrode which is an elongated strip adjacent to and extending along the second long side surface of the insulating substrate;

the resistor film includes a first longitudinal end connected to the first upper electrode;

the resistor film includes a second longitudinal end connected to the second upper electrode; and the chip resistor includes a connection position at which the resistor film is connected to the first upper electrode and another connection position at which the resistor film is connected to the second upper electrode, the connection positions being spaced from each other by a predetermined distance in a longitudinal direction of the upper surface of the insulating substrate;

the resistor film includes a first connection portion provided at the first longitudinal end for connection to the first upper electrode, and a second connection portion provided at the second longitudinal end for connection to the second upper electrode;

the first longitudinal end of the resistor film is connected to the first upper electrode via the first connection portion, and the second longitudinal end of the resistor film is connected to the second upper electrode via the second connection portion.

2. The chip resistor according to claim 1, wherein the resistor film has a meandering shape between the first connection portion connected to the first upper electrode and the second connection portion connected to the second upper electrode.

3. The chip resistor according to claim 1, wherein the first connection portion is arranged adjacent to a first short end surface of the insulating substrate, and wherein the second connection portion is arranged adjacent to a second short end surface of the insulating substrate.

4. The chip resistor according to claim 3, wherein the first connection portion and the second connection portion are narrow.

5. A chip resistor comprising:

an insulating substrate including an elongated rectangular surface as viewed in plan, the insulating substrate including a first long side surface, a second long side surface opposite to the first long side surface, a first short side surface, and a second short side surface opposite to the first short side surface;

a resistor film formed on an upper surface of the insulating substrate;

a pair of upper electrodes formed on the upper surface of the insulating substrate and electrically connected to the resistor film; and a pair of terminal electrodes formed on the first and second long side surfaces, respectively, of the insulating substrate, each terminal electrode being electrically connected to one of the upper electrodes; wherein:

the upper electrodes include a first upper electrode which is an elongated strip adjacent to and extending along the first long side surface of the insulating substrate;

the upper electrodes include a second upper electrode which is an elongated strip adjacent to and extending along the second long side surface of the insulating substrate;

the resistor film includes a first longitudinal end connected to the first upper electrode;

the resistor film includes a second longitudinal end connected to the second upper electrode; and the chip resistor includes a connection position at which the resistor film is connected to the first upper electrode and another connection position at which the resistor film is connected to the second upper electrode, the connection positions being spaced from each other by a predetermined distance in a longitudinal direction of the upper surface of the insulating substrate, the first upper electrode is L-shaped in plan view and includes a first portion positioned adjacent to and extending along the first long side surface of the insulating substrate and a second portion positioned adjacent to and extending along the first short end surface of the insulating substrate, the second upper electrode is L-shaped in plan view and includes a first portion positioned adjacent to and extending along the second long side surface of the insulating substrate and a second portion positioned adjacent to and extending along the second short end surface of the insulating substrate, the first longitudinal end of the resistor film is connected to the second portion of the first upper electrodes, the second longitudinal end of the resistor film is connected to the second portion of the second upper electrode, the paired terminal electrodes include a first terminal electrode connected to the first portion of the first upper electrode, and the paired terminal electrodes include a second terminal electrode connected to the first portion of the second upper electrode.

6. The chip resistor according to claim 5, wherein the longitudinal ends of the resistor film are narrow.

7. The chip resistor according to claim 6, wherein each of the longitudinal ends of the resistor film includes an integral extension extending in a same direction as the second portion of a corresponding one of the upper electrodes and overlapping the second portion to be connected thereto.

8. The chip resistor according to claim 5, wherein a dimension of the first portion of at least one of the paired upper electrodes along the long side surface is smaller than a length of the long side surface, the resistor film including a groove formed by trimming at a portion which does not face the first portion of the upper electrode.

9. The chip resistor according to claim 5, wherein the resistor film has a meandering shape between the first longitudinal end and the second longitudinal end.

10. A method for manufacturing a chip resistor, the method comprising:

a first step of forming a pair of upper electrodes on an upper surface of an insulating substrate that appears to be an elongated rectangle as viewed in plan, each of the paired upper electrodes being located adjacent to and extend along one of long side surfaces of the insulating substrate;

a second step of forming a resistor film on the upper surface of the insulating substrate so that the resistor film includes longitudinal ends electrically connected to the paired upper electrodes, respectively; and a third step of forming terminal electrodes on the long side surfaces of the insulating substrate to be electrically connected to the paired upper electrodes, respectively wherein the first step comprises: forming one of the paired upper electrodes into an L-shape in plan view including a first portion positioned adjacent to and extending along one of the long side surfaces of the insulating substrate and a second portion positioned adjacent to and extending along one of two short end surfaces of the insulating substrate, and forming the other one of the upper electrodes into an L-shape in plan view including a first portion positioned adjacent to and extending along the other one of the long side surfaces of the insulating substrate and a second portion positioned adjacent to and extending along the other one of the short end surfaces of the insulating substrate; and the third step comprises electrically connecting one of the terminal electrodes to the first portion of the first upper electrode and connecting the other one of the terminal electrodes to the first portion of the second upper electrode.

11. The method for forming a chip resistor according to claim 10, wherein the second step comprises: integrally forming a first connection portion for connection to one of the paired upper electrodes at one of the longitudinal ends of the resistor film while integrally forming a second connection portion for connection to the other one of the paired upper electrodes at the other one of the longitudinal ends of the resistor film so that the first and the second connection portions are electrically connected to the corresponding upper electrodes at positions spaced from each other by a predetermined distance in the longitudinal direction of the upper surface of the insulating substrate.

12. The method for forming a chip resistor according to claim 10, wherein, in the first step, at least one of the paired upper electrodes is so formed that a dimension of the first portion thereof along the long side surface be smaller than a length of the long side surface; and wherein the method further comprises a fourth step of forming, by trimming, a groove in the resistor film at a portion which does not face the first portion of the upper electrode, the fourth step being performed before the third step.

* * * * *